US011634923B2

(12) United States Patent
Krzykawski

(10) Patent No.: US 11,634,923 B2
(45) Date of Patent: Apr. 25, 2023

(54) HEADSTONE ASSEMBLY

(71) Applicant: Robert Krzykawski, Belmont, CA (US)

(72) Inventor: Robert Krzykawski, Belmont, CA (US)

(73) Assignee: Robert Krzykawski, Belmont, CA (US)

( * ) Notice: Subject to any disclaimer, the term of this patent is extended or adjusted under 35 U.S.C. 154(b) by 44 days.

(21) Appl. No.: 17/355,624

(22) Filed: Jun. 23, 2021

(65) Prior Publication Data

US 2021/0396035 A1 Dec. 23, 2021

Related U.S. Application Data

(60) Provisional application No. 63/042,888, filed on Jun. 23, 2020.

(51) Int. Cl.
*E04H 13/00* (2006.01)
*B41M 5/00* (2006.01)
*B41M 7/00* (2006.01)

(52) U.S. Cl.
CPC ..... *E04H 13/003* (2013.01); *B41M 5/007* (2013.01); *B41M 5/0011* (2013.01); *B41M 7/0045* (2013.01); *B41M 7/0081* (2013.01)

(58) Field of Classification Search
CPC .... B41M 5/011; B41M 5/0045; B41M 5/007; B41M 5/0081; E04H 13/00; E04H 13/002; E05B 65/0057
USPC ..... 52/104, 103, 105
See application file for complete search history.

(56) References Cited

U.S. PATENT DOCUMENTS 482,237 A * 9/1892 Follenius ..... E04H 13/003 40/124.5
10,233,663 B1 * 3/2019 Grupp ..... E04H 13/003
2008/0244994 A1 * 10/2008 Burman ..... E04H 13/003 52/103
2019/0192369 A1 * 6/2019 Du Bruyn ..... A61G 99/00
2022/0127873 A1 * 4/2022 Meeks ..... B28B 7/0076

* cited by examiner

*Primary Examiner* — Brian E Glessner
*Assistant Examiner* — James J Buckle, Jr.
(74) *Attorney, Agent, or Firm* — Dragon Sun Law Firm, PC; Nathaniel Perkins

(57) ABSTRACT

A headstone assembly suitable to be placed on a memorial includes a frame and a mounting assembly. The frame defines a cavity and has a base panel having a plurality of slots. The frame an inner surface defining a groove extending along and inner perimeter of the frame. The mounting assembly is arranged inside the cavity and is connected to the frame to facilitate an attachment of the base panel with the surface. The mounting assembly includes a bottom panel and a mounting panel extending inside the groove and attached to the frame and the bottom panel. The mounting assembly also includes a plurality of T-nuts extending through the mounting panel inside a plurality of the holes of the bottom panel. The T-nuts ate adapted to receive a plurality of mounting bolts extending from the surface to facilitate the attachment of the frame to the surface.

11 Claims, 3 Drawing Sheets

HEADSTONE ASSEMBLY

CROSS-REFERENCE TO RELATED APPLICATION

This application claims benefit of priority under 35 U.S.C. section 119(e) of the U.S. Provisional Patent Application Ser. No. 63/042,888, filed Jun. 23, 2020, entitled "METHOD OF PRINTING A HEADSTONE", which is hereby incorporated by reference in its entirety.

TECHNICAL FIELD

The present disclosure pertains to a headstone assembly. More particularly, the present disclosure pertains to the headstone assembly requiring less material and less time for manufacturing and incorporating the headstone assembly on a memorial.

BACKGROUND

Headstones, gravestone, tombstone is placed on a memorial of a deceased. A headstone denotes the information of a deceased and the messages from the loved ones. Typically, the headstones are created from a single workpiece of a stone/rock by cutting and/or chiseling the workpiece into a desired shape. However, several limitations exist with the headstone such as the chiseling of the workpiece is a time consuming and a labor-intensive process. In addition, high cost is incurred in transporting and installing the headstone on the memorial due to its high weight. So, to overcome these limitations the present disclosure discloses a headstone assembly.

SUMMARY

According to an aspect of the disclosure, a headstone assembly suitable to be placed on a memorial is provided. The headstone assembly includes a frame and a mounting assembly for mounting the frame on a surface. The frame defines a cavity and has a base panel having a plurality of slots and is adapted to be mounted on the surface. The frame has an inner surface defining a groove extending along and inner perimeter of the frame and arranged proximate to the base panel. The mounting assembly is arranged inside the cavity and is connected to the frame to facilitate an attachment of the base panel with the surface. The mounting assembly includes a bottom panel arranged abutting the base panel and defining a plurality of holes, and a mounting panel extending inside the groove and attached to the frame and the bottom panel. The mounting assembly also includes a plurality of T-nuts extending through the mounting panel inside the plurality of the holes of the bottom panel. The T-nuts ate adapted to receive a plurality of mounting bolts extending from the surface via the plurality of slots of the base panel to facilitate the attachment of the frame to the surface.

In one embodiment, the mounting assembly further includes a locking panel arranged abutting the mounting panel such that mounting panel is arranged between the bottom panel and the locking panel. The locking panel is adapted to receive and retain heads of the T-nuts.

In an embodiment, the locking panel includes a plurality of first holes to receive the heads of the T-nuts.

According to an embodiment, the frame includes a front panel, a back panel, and one or more side panels arranged between the front panel and the back panel.

In one embodiment, the groove includes a first groove portion defined by the front panel and a second groove portion defined by the back panel.

According to one embodiment, the one or more side panels include a first side panel and a second side panel disposed spaced apart and substantially parallel to the first side panel. The first side panel defines a third groove portion of the groove and the second side panel defines a fourth groove portion of the groove.

In one embodiment, the one or more side panels are adhesively attached to the front panel and the back panel.

According to one embodiment, the base panel is adhesive attached to the front panel, the back panel and one or more side panels.

In an embodiment, the headstone assembly further includes a one or more light sources arranged inside the cavity and attached to the frame to facilitate an illumination of the frame.

In an embodiment, the frame includes a translucent material to facilitate a glowing of the frame.

According to one embodiment, the headstone assembly further includes one or more graphics formed on an outer surface of the frame.

DETAILED DESCRIPTION

Figure 1:
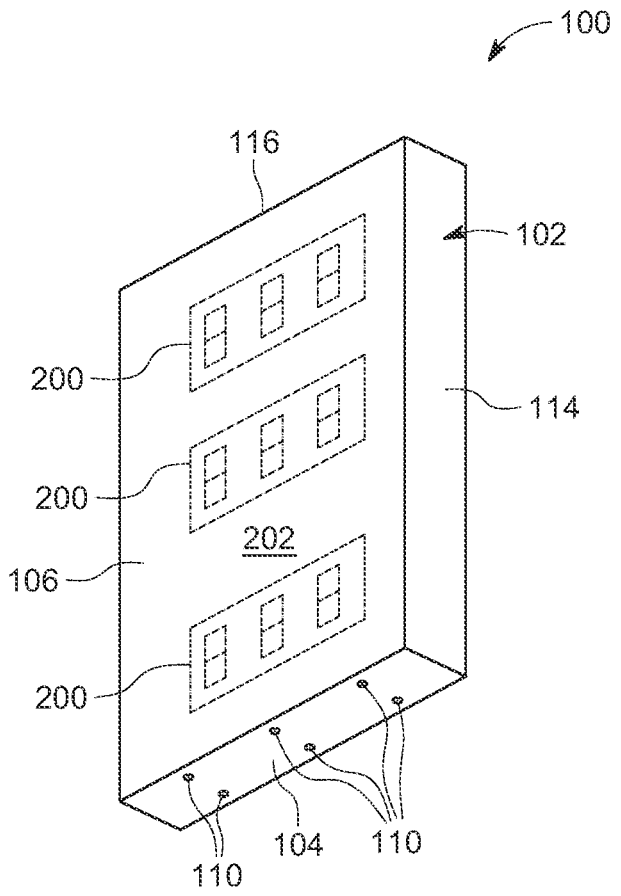
FIG. 1 illustrates a perspective view of a headstone assembly depicting a frame, in accordance with an embodiment of the disclosure.
Figure 2:
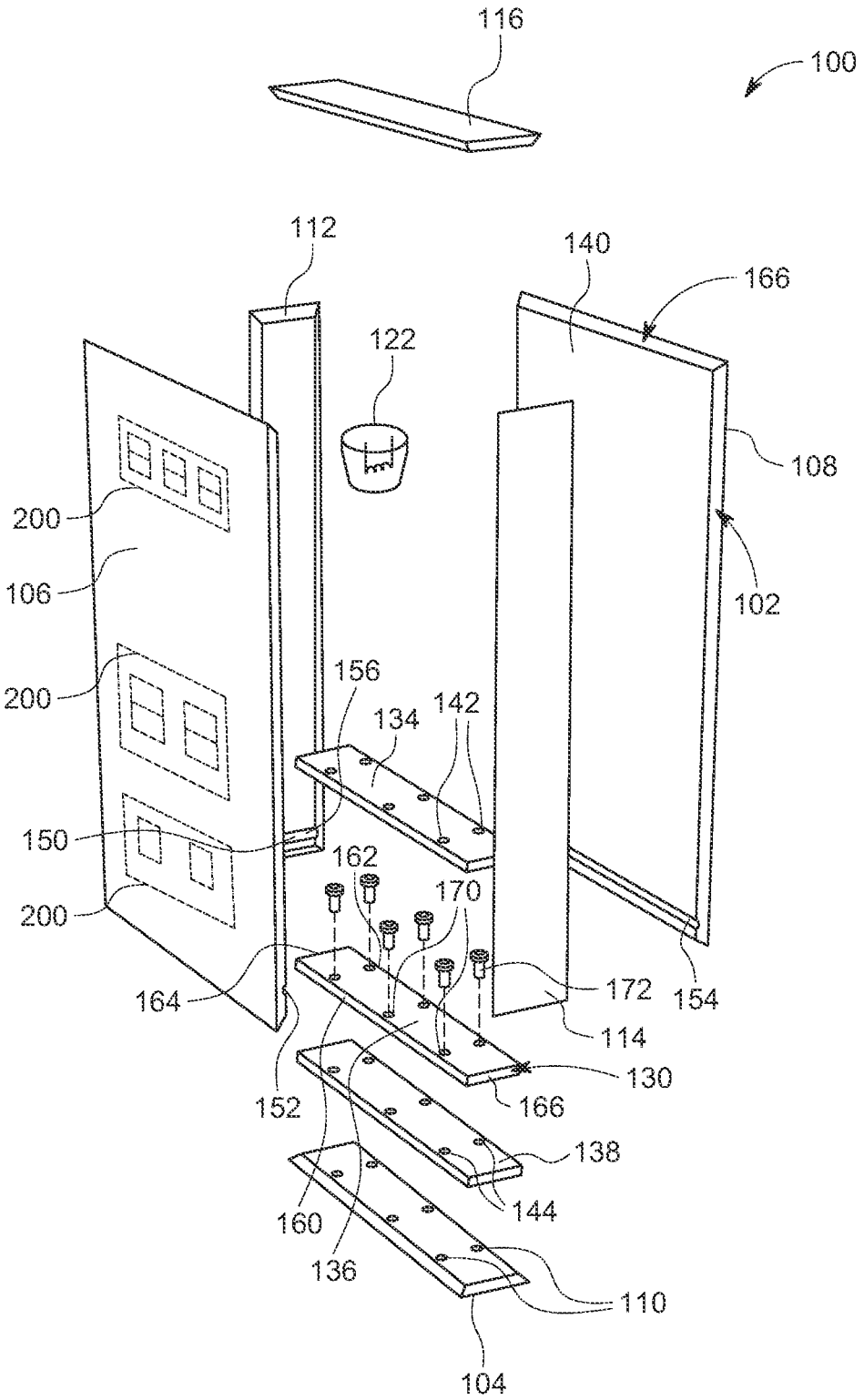
FIG. 2 illustrates an exploded view of the headstone assembly of FIG. 1, in accordance with an embodiment of the disclosure.
Figure 3:
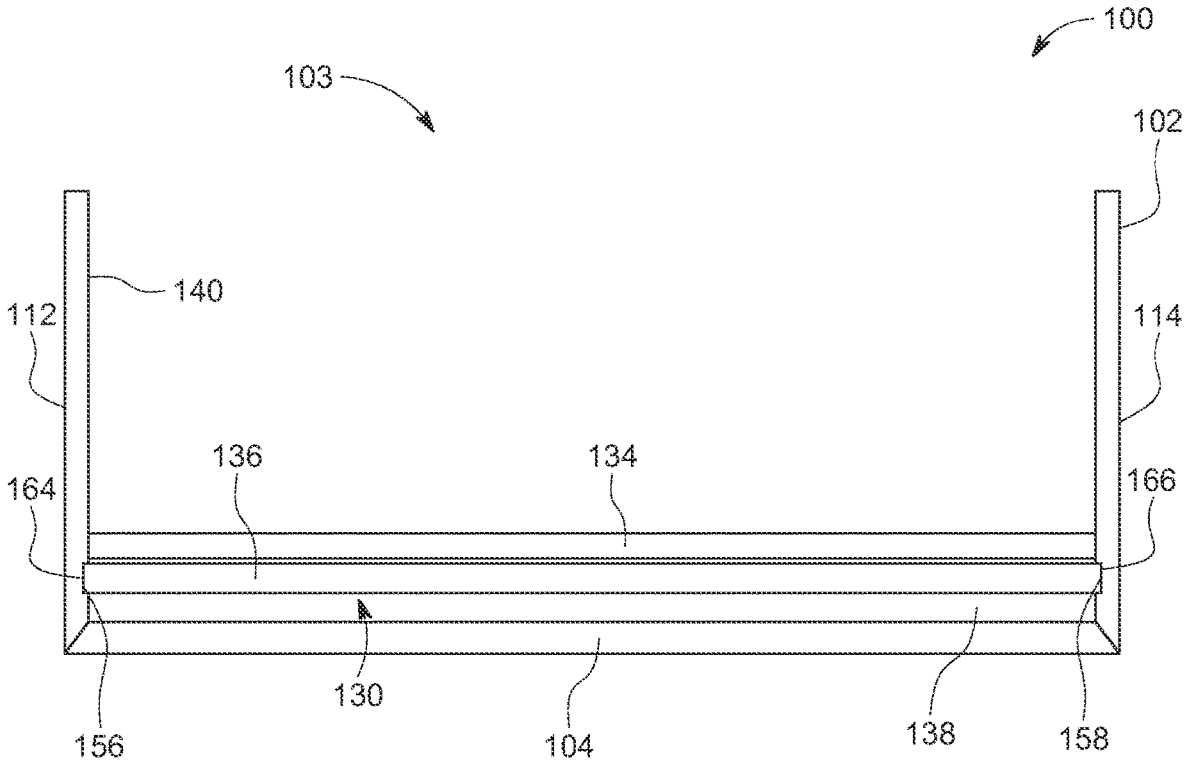
FIG. 3 illustrates a front view of a bottom section of the headstone assembly of FIG. 1 with a front panel removed from the frame and depicting a mounting assembly attached to the frame, in accordance with an embodiment of the disclosure.

Referring to FIGS. 1 to 3, a headstone assembly 100 suitable to be placed on a memorial is disclosed. The headstone assembly 100 depicts one or more graphics 200 including one or more images and/or one or more messages from the loved ones to the deceased. The headstone assembly 100 includes a hollow frame 102 defining a cavity 103 (shown in FIG. 3) and including a base panel 104 adapted to be placed on the memorial or a ground surface, a front panel 106, a back panel 108 disposed substantially parallel to and spaced apart from the front panel 106, and one or more side panels disposed between the front panel 106 and the back panel 108. The base panel 104 may include a plurality of slots 110 for receiving a plurality of bolts extending from a ground surface or the memorial to facilitate a mounting/attachment of the headstone assembly 100 to the ground or the memorial. The front panel 106 and the back panel 108 may extend upwardly from the base panel 104 and may be disposed substantially perpendicular to the base panel 104, while the one or more side panels, for example, a first side panel 112, a second side panel 114 disposed spaced apart and substantially parallel to the first side panel 112, and a top side panel 116, extends from the front panel 106 to the back panel 108. Although three side panels 112, 114, 116 are shown and contemplated, it may be envisioned that the frame 102 may include a single side panel, two side panel, or more than three side panels depending on the shape and configuration of the frame 102. Also, as shown, the side panels 112, 114, 116 may be disposed substantially perpendicular to the front panel 106 and the back panel 108.

Further, the front panel 106 and the back panel 108 are removably coupled to the base panel 104 using adhesive. Similarly, the first side panel 112 and the second side panel 114 may be adhesively coupled to longitudinal edges of the front panel 106 and the back panel 108, while the top side panel 116 may be adhesively coupled to top lateral edges of the front panel 106 and the back panel 108, and is also adhesively coupled to top lateral edges of the first side panel 112 and the second side panel 114. As an example, the panels 106, 108, 112, 114, 116 may be made of a non-ferrous material like stone, granite, marble, natural stone or any other composite stone known in the art. In an embodiment, the panels 106, 108, 112, 114, 116 108 may include a translucent material for facilitating a glowing of the frame. In an embodiment, the headstone assembly 100 may include one or more light source 122 (shown in FIG. 2) disposed inside the cavity 103 and attached to the frame 102 for facilitating the illumination of the panels 106, 108, 112, 114, 116. The one or more light source 122 may be attached to one or more of the panels 106, 108, 112, 114, 116. In certain implementations, the one or more light source 122 may be attached to the base panel 104.

Moreover, the headstone assembly 100 may include a mounting assembly 130 for connecting and securing the base panel 104, the first side panel 112, the second side panel 114, the front panel 106, and the back panel 108 together. Further, the mounting assembly 130 facilitates a mounting of the headstone assembly 100 to a ground surface or to a memorial. The mounting assembly 130 is disposed inside the cavity 103 and may include a locking panel 134, a mounting panel 136, and a bottom panel 138 abutted to the base panel 104 and adhesively attached to the base panel 104. As shown, the locking panel 134 and the bottom panel 138 are of same dimensions, and contacts an inner surface 140 of the frame 102, and, respectively, includes a plurality of first holes 142 and a plurality of second holes 144. Moreover, the locking panel 134 and the bottom panel 138, each contacts the side panels 112, 114, the front panel 106, and the back panel 108. Further, the inner surface 140 of the frame 102 defines a groove 150 that extends along an inner periphery of the frame 102. Accordingly, the groove 150 includes a first groove portion 152 (shown in FIG. 2) defined by the front panel 106 and extending along a width of the front panel 106, a second groove portion 154 (shown in FIG. 2) defined by the back panel 108 and extending along a width the back panel 108, a third groove portion 156 (shown in FIGS. 2 and 3) defined by the first side panel 112 and extending along a width of the first side panel 112, and a fourth groove portion 158 (shown in FIG. 3) defined by the second side panel 114 and extending along a width of the second side panel 114. The groove 150 is adapted to receive the mounting panel 136, and therefore facilitates a coupling and holding of the front panel 106, the back panel 108, the first side panel 112, and the second side panel 114 together.

For facilitating an insertion of the mounting panel 136 inside the groove 150, a length and a width of the mounting panel 136 is larger than a width and a length of the locking panel 134 and/or the bottom panel 138. Therefore, in an assembly of the mounting panel 136 with the frame 102, a first longitudinal end 160 is disposed inside the first groove portion 152, while a second longitudinal end 162 is disposed inside the second groove portion 154. Similarly, a first lateral end 164 is disposed inside the third groove portion 156, while a second lateral end 166 is disposed inside the fourth grove portion 158. Further, the mounting panel 136 includes a plurality of third holes 170 for receiving a plurality of nuts 172, such as 'T-nuts', which receive the mounting bolts extending from the ground or the memorial to facilitate the attachment of the headstone assembly 100 to the ground or the memorial. The nuts 172 may extend into the second holes 144 of the bottom panel 138 and may partially extend into the first holes 142 of the locking panel 134. In an embodiment, the first holes 142 may be blind holes and receive heads of the nuts 172, and thereby locks the nuts 172 inside the bottom panel 138 and the mounting panel 136, and prevent the falling of the nuts 172 inside the cavity 103. Further, in an assembly, the mounting panel 136 is sandwiched between the locking panel 134 and the bottom panel 138, while the bottom panel 138 is abutted with the base panel 104. Also, the locking panel 134 is disposed distally to the base panel 104 relative to the bottom panel 138. In an embodiment, the bottom panel 138 may be adhesively attached to the base panel 104, and the bottom panel 138, the locking panel 134, and the mounting panel 136 are also adhesively joined together.

Additionally, or optionally, the headstone assembly 100 includes a roof (not shown) to provide a cover to the frame 102. Moreover, the headstone assembly 100 may include the graphics 200 and/or an inscription formed on an outer surface 202 of the frame 102. In an implementation, a digital printer may be used for printing graphics 200 and/or inscription on the outer surface 202 of the frame 102. The graphics 200 and/or the inscription may be cured using ultraviolet radiation for improving abrasion resistance and anti-fading properties against the sunlight.

The advantage of the headstone assembly 100 is now explained. The headstone assembly 100 is lighter as compared to a conventional headstone assembly made of a single workpiece. The assembly time required to assemble the headstone assemble 100 is less as compared to the construction time required to chisel the conventional headstone from the single workpiece of stone/rock. The material requirement, energy required for production and the residual material generated during the assembly and production of the headstone assembly 100 is less as compared to the conventional headstone. In addition, the process of assembling the headstone assembly 100 includes fewer environmental impacts as compared to the hazardous process of chiseling the stone for converting it into the shape of the conventional headstone. Also, the installation and the transportation process of the headstone assembly 100 are faster and consume less resources as compared to the manufacturing process and the transportation time required with the conventional headstone.

It should be understood that the foregoing description is only illustrative of the aspects of the disclosed embodiments. Various alternatives and modifications can be devised by those skilled in the art without departing from the aspects of the disclosed embodiments. Accordingly, the aspects of the disclosed embodiments are intended to embrace all such alternatives, modifications, and variances that fall within the scope of the appended claims. Further, the mere fact that different features are recited in mutually different dependent or independent claims does not indicate that a combination of these features cannot be advantageously used, such as a combination remaining within the scope of the aspects of the disclosed embodiments.

What is claimed is:

1. A headstone assembly suitable to be placed on a memorial, the headstone assembly comprising:

a frame defining a cavity and having a base panel having a plurality of slots and is adapted to be mounted on a surface of the memorial, the frame includes an inner surface defining a groove extending along an inner perimeter of the frame and arranged proximate to the base panel; and a mounting assembly arranged inside the cavity and connected to the frame to facilitate an attachment of the base panel with the surface of the memorial, the mounting assembly including a bottom panel arranged abutting the base panel and defining a plurality of holes, a mounting panel extending inside the groove and attached to the frame and the bottom panel, and a plurality of T-nuts extending through the mounting panel inside the plurality of the holes of the bottom panel and is adapted to receive a plurality of mounting bolts extending from the surface of the memorial via the plurality of slots of the base panel to facilitate the attachment of the frame to the surface.

2. The headstone assembly of claim 1, wherein the mounting assembly further includes a locking panel arranged abutting the mounting panel such that the mounting panel is arranged between the bottom panel and the locking panel, wherein the locking panel is adapted to receive and retain heads of the T-nuts.

3. The headstone assembly of claim 2, wherein the locking panel includes a plurality of first holes to receive the heads of the T-nuts.

4. The headstone assembly of claim 1, wherein the frame includes a front panel, a back panel, and one or more side panels arranged between the front panel and the back panel.

5. The headstone assembly of claim 4, wherein the groove includes a first groove portion defined by the front panel and a second groove portion defined by the back panel.

6. The headstone assembly of claim 4, wherein the one or more side panels include a first side panel and a second side panel disposed spaced apart and substantially parallel to the first side panel, wherein the first side panel defines a third groove portion of the groove and the second side panel defines a fourth groove portion of the groove.

7. The headstone assembly of claim 4, wherein the one or more side panels are adhesively attached to the front panel and the back panel.

8. The headstone assembly of claim 4, wherein the base panel is adhesive attached to the front panel, the back panel and one or more side panels.

9. The headstone assembly of claim 1 further including one or more light sources arranged inside the cavity and attached to the frame to facilitate an illumination of the frame.

10. The headstone assembly of claim 9, wherein the frame includes a translucent material to facilitate a glowing of the frame.

11. The headstone assembly of claim 1 further including one or more graphics formed on an outer surface of the frame.

* * * * *